US005819709A

United States Patent [19]

Holmes et al.

[11] Patent Number: 5,819,709

[45] Date of Patent: Oct. 13, 1998

[54] FUEL PUMP CONTROL IN AN ELECTRONIC RETURNLESS FUEL DELIVERY SYSTEM

[75] Inventors: John William Holmes, Eastpointe; Lawrence Herris Buch, Farmington Hills, both of Mich.

[73] Assignee: Ford Global Technologies, Inc., Dearborn, Mich.

[21] Appl. No.: 851,233

[22] Filed: May 5, 1997

[51] Int. Cl.[6] ..... F02M 37/04

[52] U.S. Cl. ..... 123/497

[58] Field of Search ..... 123/495, 497, 123/514, 492

[56] References Cited

U.S. PATENT DOCUMENTS

| | | | |
|---|---|---|---|
| 3,817,225 | 6/1974 | Priegel . | |
| 3,951,113 | 4/1976 | Wessel et al. . | |
| 4,205,648 | 6/1980 | Graham . | |
| 4,791,905 | 12/1988 | Furuta et al. | 123/497 |
| 5,154,152 | 10/1992 | Yamane et al. | 123/492 |
| 5,159,914 | 11/1992 | Follmer et al. | 123/494 |
| 5,483,940 | 1/1996 | Namba et al. | 123/497 |
| 5,505,180 | 4/1996 | Otterman et al. | 123/497 |
| 5,579,738 | 12/1996 | Frischmuth et al. | 123/497 |
| 5,609,140 | 3/1997 | Kramer et al. | 123/497 |
| 5,699,772 | 12/1997 | Yonekawa et al. | 123/497 |
| 5,740,783 | 4/1998 | Learman et al. | 123/497 |

*Primary Examiner*—Thomas N. Moulis
*Attorney, Agent, or Firm*—Neil P. Ferraro

[57] ABSTRACT

An electrically powered fuel pump in an electronic returnless fuel delivery system for an internal combustion engine is controlled during transient engine operating conditions. A controller senses an operating parameter to infer whether a transient engine operating condition exists. Then, the controller generates an estimate of a fuel pump correction signal based on this inference. The correction signal is generally sufficient to cause the fuel pump to respond to the transient condition, by supplying a generally correct amount of fuel, prior to the engine requiring a change in fuel quantity.

14 Claims, 3 Drawing Sheets

FUEL PUMP CONTROL IN AN ELECTRONIC RETURNLESS FUEL DELIVERY SYSTEM

FIELD OF THE INVENTION

The present invention relates to electronic returnless fuel delivery systems, and more particularly, to controlling a fuel pump in an electronic returnless fuel delivery system.

BACKGROUND OF THE INVENTION

Conventional control strategy for an electronic returnless fuel delivery system for an internal combustion engine typically comprises a series of calculations aimed at obtaining the proper quantity of fuel to be delivered to the engine with little or no fuel returned to the fuel tank. Typically, a mass air flow sensor is installed in the air intake system at an upstream position of a throttle valve to accurately detect the mass air flow rate of the air into the engine. An engine controller then manipulates the sensed mass air flow using a physically based manifold filling model, which takes into account parameters such as engine displacement, manifold volume and volumetric efficiency, to determine the air charge entering the engine's combustion chambers. Once this cylinder air charge is calculated, the corresponding desired fuel charge is computed based on a desired air/fuel ratio and manifold absolute pressure (MAP). The controller then calculates a desired feedforward (open loop) fuel pump voltage so the pump may supply fuel to the fuel rail at a desired pressure. The controller also calculates a desired fuel injection pulsewidth based on the difference between fuel rail pressure and MAP.

This sequence of events, however, assumes a steady state condition between the time the mass air flow is first measured at the mass air flow sensor to the time the feedforward voltage signal is communicated to the fuel pump. In a transient engine operating condition, however, such as a "tip-in" or "tip-out", which is herein defined as a rapid throttle positional change such as a rapid opening and closing of the throttle valve, respectively, the desired feedforward fuel pump voltage is no longer valid. This is because the feedforward fuel pump voltage calculations are performed asynchronously with, and much less frequently than, the cylinder air charge calculations. Any attempt to perform the desired feedforward fuel pump voltage calculations at the same time and speed as the cylinder air charge calculations would slow the engine controller down such that its ability to control other engine systems would be impaired. Typically, during such a transient condition, the fuel rail pressure departs from a desired value due, in part, to the need to rely upon obsolete values of the desired feedforward fuel pump voltage.

In addition to the above mentioned feedforward voltage calculations, prior electronic returnless fuel systems may employ feedback correction calculations. Because the fuel injector pulsewidth is calculated based on the difference in pressure between the fuel rail pressure and MAP, any departure from the desired fuel rail pressure results in a fuel rail pressure error, which must occur before a feedback error correction voltage is added to or subtracted from the desired feedforward fuel pump voltage so the pump may increase or decrease fuel rail pressure accordingly. As a result, during transient engine operating conditions, because the air charge to the cylinder can change within one cylinder event, the engine may operate in either a rich or a lean condition prior to the feedback control correcting the voltage to the fuel pump.

SUMMARY OF THE INVENTION

An object of the present invention is to provide an engine with a proper amount of fuel during transient operating conditions. This object is achieved and the disadvantages of prior art approaches are overcome by providing a novel method for controlling an electronically powered fuel pump in an electronic returnless fuel delivery system for an internal combustion engine during a transient engine operating condition. In one particular aspect of the invention, the method includes the steps of sensing an engine operating parameter for a first time, sensing the engine operating parameter for a second time, and inferring whether a transient engine operating condition occurred between the first and second times by comparing the difference in engine operating parameters between the first and second times and determining whether the comparison is above a threshold level. Next, the method includes the step of generating an estimate of a fuel pump correction signal based on this inference. The correction signal has a value proportional to the magnitude of the compared difference and is generally sufficient to cause the fuel pump to respond to the transient condition by supplying a generally correct amount of fuel to the engine prior to the engine requiring a change in fuel quantity, thereby allowing the engine to suitably respond to the transient condition.

In a preferred embodiment, the sensed engine operating parameter is desirably one that is sensed often and sensed asynchronously with respect to feedforward fuel pump voltage calculations. Accordingly, the sensed engine operating parameter may be mass air flow or throttle position.

An advantage of the present invention is that a generally correct amount of fuel is supplied to the engine.

Another, more specific, advantage of the present invention is that a generally correct air/fuel ratio is maintained during transient engine operating conditions.

Still another advantage of the present invention is that fuel is delivered to the engine at a correct pressure.

Yet another advantage of the present invention is that regulated emissions are reduced.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
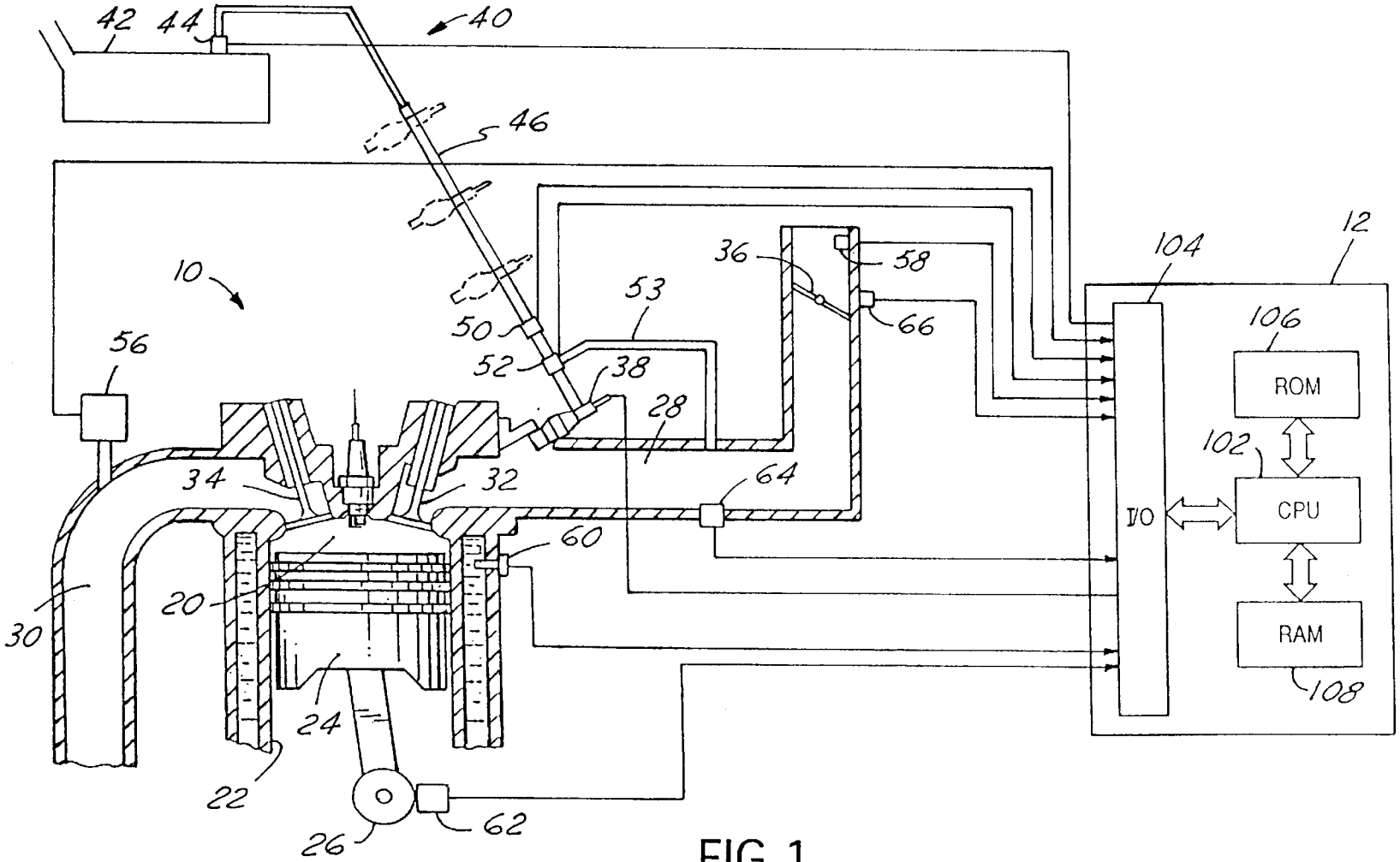
FIG. 1 is a block diagram of a fuel delivery system incorporating the present invention.

Internal combustion engine 10, comprising a plurality of cylinders, one of which is shown in FIG. 1, is controlled by electronic engine controller 12. Engine 10 includes combustion chamber 20 and cylinder walls 22. Piston 24 is positioned within cylinder walls 22 with conventional piston rings and is connected to crankshaft 26. Combustion chamber 20 communicates with intake manifold 28 and exhaust manifold 30 by respective intake valve 32 and exhaust valve 34, respectively. Intake manifold 28, communicating with throttle 36, includes fuel injector 38 coupled thereto for delivering fuel in proportion to a signal received from controller 12.

Fuel is delivered to fuel injector 38 by electronic returnless fuel delivery system 40, which comprises fuel tank 42, electric fuel pump 44 and fuel rail 46. According to the present invention, fuel pump 44 pumps fuel at a pressure directly related to the voltage applied to fuel pump 44 by controller 12. In this particular example, a separate fuel injector for each engine cylinder (not shown) is coupled to fuel rail 46. Also coupled to fuel rail 46 are fuel temperature sensor 50 and fuel pressure sensor 52. Pressure sensor 52 senses fuel rail pressure relative to manifold absolute pressure (MAP) via sense line 53.

Controller 12, shown in FIG. 1, is a conventional microcomputer including microprocessor unit 102, input/output ports 104, electronic storage medium for storing executable programs, shown as "Read Only Memory" chip 106, in this particular example, "Random Access Memory" 108, and a conventional data bus. Controller 12 receives various signals from sensors coupled to engine 10, in addition to those signals previously discussed, including: measurement of mass air flow from mass air flow sensor 58, engine temperature from temperature sensor 60, a profile ignition pick-up signal from Hall effect sensor 62, coupled to crankshaft 26, intake manifold absolute pressure (MAP) from pressure sensor 64 coupled to intake manifold 28, and position of throttle 36 from throttle position sensor 66.

As previously stated, fuel charge is determined through a series of calculations performed by controller 12. According to the present invention, controller 12 infers that a transient condition is occurring by determining an increase or decrease in mass air flow sensed by sensor 58. Controller 12 then adjusts voltage to pump 44 based on this inference to compensate for any subsequent increase or decrease in fuel as will be fully described hereinafter.

Figure 2:
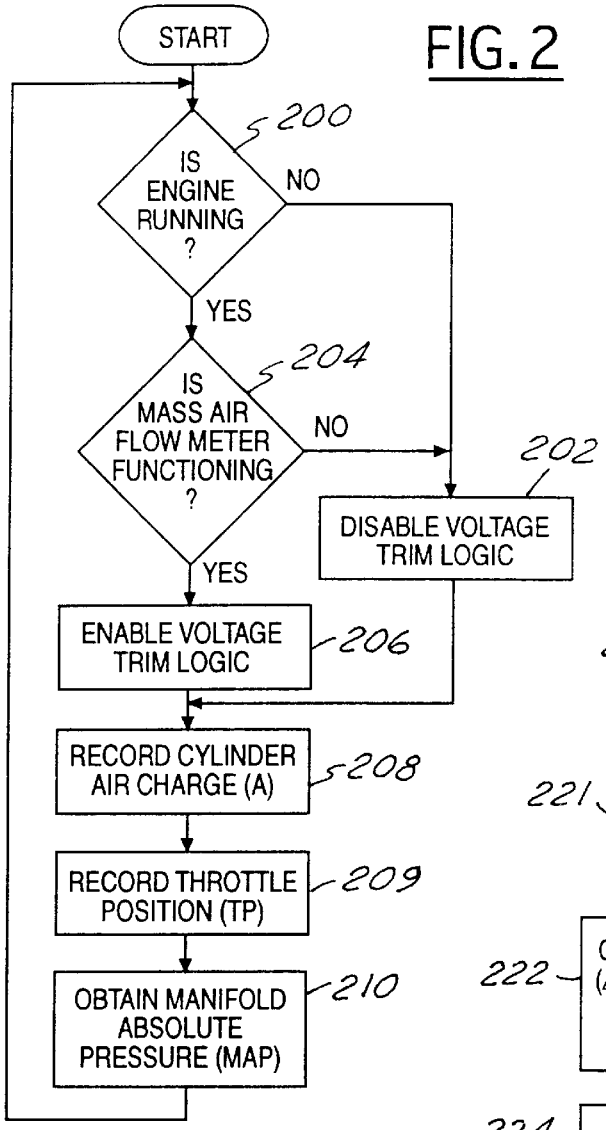
FIGS. 2 and 3 are flow charts describing various operations performed by the present invention; and, FIG. 4 is a schematic representation of a control system according to the present invention.

Referring in particular to FIG. 2, controller 12 determines whether or not engine 10 is running, shown at step 200, because it may be undesirable to adjust the voltage to the pump during engine start. Accordingly, if the engine is cranking, fuel pump voltage adjustment (also herein referred to as voltage trim logic) is disabled, as shown at step 202. On the other hand, if engine 10 is running (not in a cranking mode), controller 12 next determines whether mass air flow sensor 58 is functioning. If mass air flow sensor 58 is not functioning, the voltage trim logic is disabled at step 202. If, on the other hand, mass air flow sensor 58 is functioning, the voltage trim logic is enabled, as shown in step 206. Next, at step 208, controller 12 determines the cylinder air charge (A) first by sensing the mass air flow sensed by sensor 58, then by manipulating the sensed mass air flow using a physically based manifold filling model known to those skilled in the art and suggested by this disclosure. At step 209, controller 12 may record throttle position (TP). Proceeding from step 209, at step 210, controller 12 obtains MAP either through sensor 64 or, in an alternative embodiment, by inferring MAP by methods known to those skilled in the art and suggested by this disclosure. MAP is needed because fuel pressure in fuel rail 46 is maintained at a desired level relative to MAP, typically 40 psi above MAP, through sense line 53. Accordingly, it is desirable to maintain the 40 psi pressure above manifold absolute pressure in the fuel rail 46 by controlling fuel pump 44.

During a transient condition (either a "tip-in" or "tip-out"), one of the first sensors to respond is mass air flow sensor 58. A time lag exists between the time when mass air flow sensor 58 records air flow through throttle valve 36 and the time when the feedforward fuel pump voltage calculations are performed and a feedforward voltage signal is sent to fuel pump 44 to allow fuel pump 44 to respond accordingly. Attaining the proper fuel rail pressure is also delayed because of the time required to pressurize the system. However, because MAP responds relatively quickly to the change in mass air flow, the fuel rail pressure to which fuel pump 44 had been pumping to maintain the 40 psi pressure differential is no longer valid due to this relatively slow fuel pump control logic response. Further, in feedback systems, an error must occur prior to any subsequent corrective action.

Figure 3:
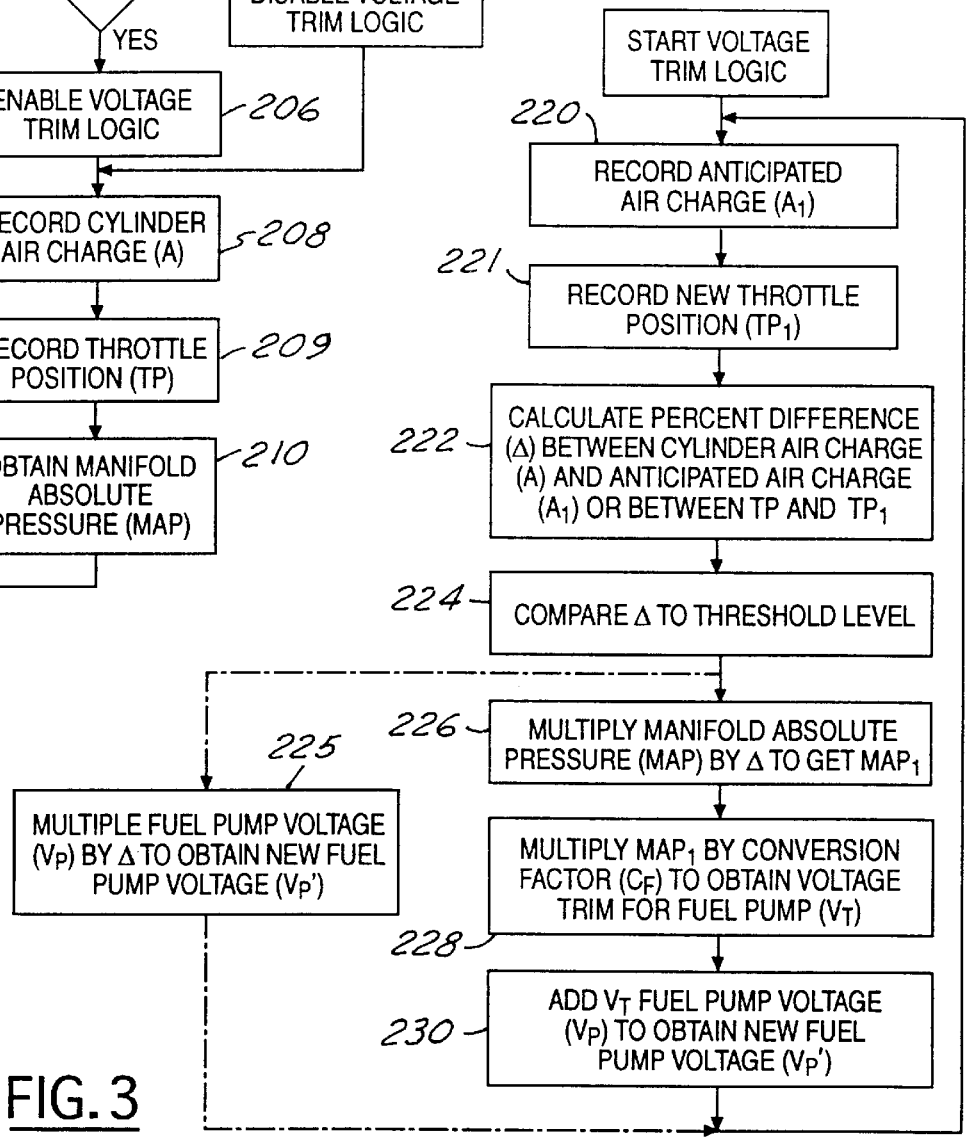

According to the present invention, controller 12 infers that a transient condition is occurring and adjusts the fuel pump voltage so that the fuel rail pressure may be maintained at the desired level above MAP prior to the engine requiring a change in fuel quantity as indicated by, for example, a feedback error signal from either fuel pressure sensor 52, MAP sensor 64, or inferred MAP, or by recalculating a new feedforward fuel pump voltage, thereby eliminating the aforementioned time lag. The way this is accomplished is best explained with reference to FIGS. 3 and 4. At step 220, controller 12 records an anticipated air charge ($A_1$), which is the present sensed mass air flow sensed by mass air flow sensor 58. Controller 12 may also record a new throttle position ($TP_1$), as shown at step 221. At step 222, controller 12 calculates the percentage difference ($\Delta$) between the cylinder air charge (A) recorded prior at step 208 and the anticipated air charge ($A_1$) recorded presently at step 220 or the percentage difference ($\Delta$) between the TP recorded prior at step 209 and $TP_1$ recorded presently at step 221. Thus, in an alternative embodiment, $\Delta$ may be calculated from present and prior positions of throttle 26 as sensed by throttle position sensor 66. Of course, as previously stated, sensed mass air flow may be used directly instead of the calculated cylinder air charge (A, $A_1$). At step 224, $\Delta$ is compared to a threshold level to infer that a transient has occurred. At step 225, the present pump voltage ($V_p$) is multiplied by $\Delta$ to get the new fuel pump voltage ($V_p'$). This is all accomplished prior to the cylinder air charge (A) reaching combustion chamber 20. The air/fuel ratio first calculated is still used, however, the voltage to pump 44 is adjusted, according to the present invention, so that the proper fuel pressure will be available at fuel rail 46 when engine 10 must respond to the transient condition. For the sake of completeness, an increase in demand for fuel, for example, may be supplied to combustion chamber 20 by injecting an additional amount of fuel into combustion chamber 20, increasing the fuel injector pulsewidth, or other methods known to those skilled in the art and suggested by this disclosure as desired.

In a preferred embodiment, it may be desirable to obtain a new MAP which will likely occur based on the inference that a transient condition is occurring. That is, at step 226, controller 12 multiplies MAP obtained at step 210 by $\Delta$ to get a new operating manifold absolute pressure ($MAP_1$). Controller 12 then, at step 226, multiplies $MAP_1$ by a conversion factor ($C_f$) to obtain a voltage trim ($V_t$) for the fuel pump. At step 228, the voltage trim ($V_t$) is added to the present fuel pump voltage ($V_p$) to obtain a new fuel pump operating voltage ($V_p'$).

Figure 4:
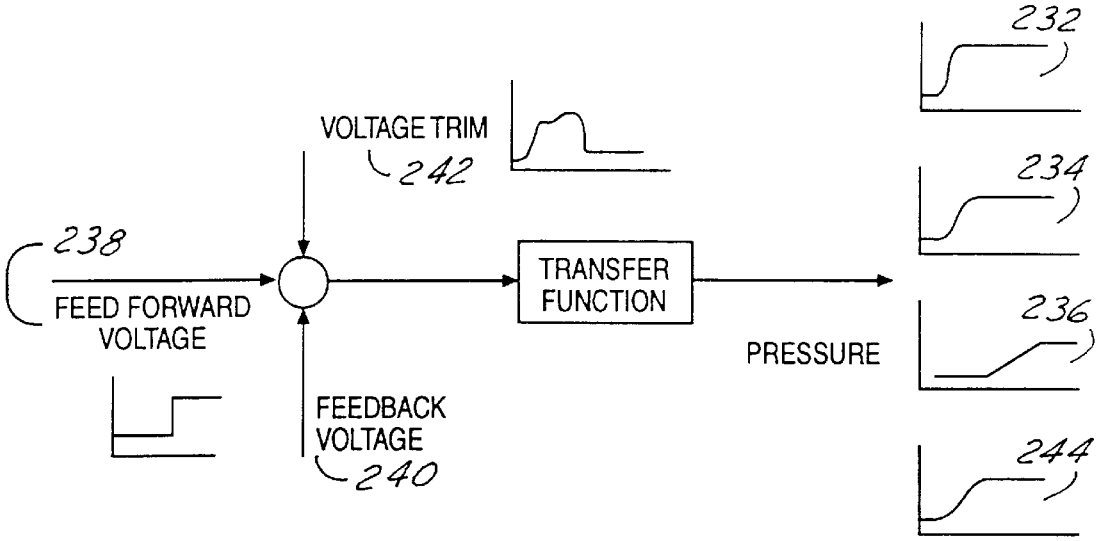

FIG. 4 is a schematic representation of the control system according to the present invention. When a transient occurs, the desired fuel rail pressure changes within milliseconds, as shown at 232. Ideally, the actual fuel rail pressure would respond in a similar step manner, shown at 234. However, this ideal response is delayed in a fuel rail pressure control strategy that depends solely on feedforward and feedback voltage, as shown at 236. Due to computational lags, the feedforward voltage calculation, which is a step function, shown at 238, occurs at a later point in time. Further, should the fuel rail pressure not be at a desired pressure, the feedback voltage, shown at 240, is added to the fuel pump voltage. While this feedback voltage further refines the fuel pump output so as to attain the desired fuel rail pressure, it also has inherent lags. According to the present invention, a voltage trim adjustment, shown at 242, is also added to the fuel pump voltage to reduce the effects of the aforementioned time lags. This results in the output (fuel rail pressure) approaching the ideal output of 232, as shown at 244. As previously stated, the voltage trim is a function of a sensed engine operating parameter such as mass air flow or throttle position.

Thus, according to the present invention, controller 12 controls fuel pump 44 (FIG. 1) such that fuel pump 44 is driven to a different operating state prior to engine 10 responding to the transient condition such that when engine 10 responds to this transient condition, adequate fuel pressure is available at fuel rail 46. That is, fuel pump 44 is commanded to operate to a different operating level based on an inference that a transient condition is occurring.

While the best mode for carrying out the invention has been described in detail, those skilled in the art in which this invention relates will recognize various alternative designs and embodiments, including those mentioned above, in practicing the invention that has been defined by the following claims.

We claim:

1. A method of controlling an electrically powered fuel pump in an electronic returnless fuel delivery system for an internal combustion engine during a transient engine operating condition, with said method comprising the steps of:

sensing an engine operating parameter for a first time;

sensing said engine operating parameter for a second time;

inferring whether a transient engine operating condition occurred between said first and second times by comparing the difference in engine operating parameters between said first and second times and determining whether said comparison is above a threshold level; and, generating an estimate of a fuel pump correction signal based on said inference, with said correction signal having a value proportional to the magnitude of said compared difference and being generally sufficient to cause the fuel pump to respond to said transient condition by supplying a generally correct amount of fuel to the engine prior to the engine requiring a change in fuel quantity, thereby allowing the engine to suitably respond to said transient condition.

2. A method according to claim 1 wherein said engine operating parameter comprises mass air flow.

3. A method according to claim 1 wherein said engine operating parameter comprises throttle position.

4. A method according to claim 2 further comprising the steps of:

obtaining manifold absolute pressure of said engine; and, inferring a new manifold absolute pressure based on said obtained manifold absolute pressure and said calculated difference in mass air flow.

5. A method according to claim 4 further comprising the steps of:

converting said inferred manifold absolute pressure into said fuel pump correction signal.

6. A method of controlling an electrically powered fuel pump in an electronic returnless fuel delivery system for an internal combustion engine during a transient engine operating condition, with said method comprising the steps of:

sensing mass air flow for a first time;

sensing said mass air flow for a second time;

obtaining manifold absolute pressure of said engine at said first time;

calculating a difference in said sensed mass air flow between said first and second times;

inferring whether a transient engine operating condition occurred between said first and second times by determining whether said calculated difference is above a threshold level;

inferring a new manifold absolute pressure based on said obtained manifold absolute pressure and said calculated difference in mass air flow;

generating an estimate of a fuel pump correction signal based on said inferred new manifold absolute pressure, with said correction signal having a value proportional to the magnitude of said difference in said calculated mass air flow and being generally sufficient to cause the fuel pump to respond to said transient condition by supplying a generally correct amount of fuel to the engine prior to the engine requiring a change in fuel quantity, thereby allowing the engine to suitably respond to said transient condition.

7. An article of manufacture comprising:

a computer storage medium having a computer program encoded therein for causing a computer to control an electrically powered fuel pump in an electronic returnless fuel delivery system for an internal combustion engine during a transient engine operating condition, with said computer storage medium comprising:

a computer readable program code means for causing said computer to sense an engine operating parameter for a first time;

a computer readable program code means for causing said computer to sense said engine operating parameter for a second time;

a computer readable program code means for causing said computer to infer whether a transient engine operating condition occurred between said first and second times by comparing the difference in engine operating parameters between said first and second times and determining whether said comparison is above a threshold level; and, a computer readable program code means for causing said computer to generate an estimate of a fuel pump correction signal based on said inference, with said correction signal having a value proportional to the magnitude of said compared difference and being generally sufficient to cause the fuel pump to respond to said transient condition by supplying a generally correct amount of fuel to the engine prior to the engine requiring a change in fuel quantity, thereby allowing the engine to suitably respond to said transient condition.

8. An article of manufacture according to claim 7 a computer readable program code means for causing said computer to infer whether a transient engine operating condition occurred between said first and second times comprises a computer readable program code means for causing said computer to calculate a difference in said sensed operating parameters between said first and second times.

9. An article of manufacture according to claim 8 wherein said engine operating parameter comprises mass air flow.

10. An article of manufacture according to claim 8 wherein said engine operating parameter comprises throttle position.

11. An article of manufacture according to claim 9 further comprising:

a computer readable program code means for causing said computer to obtain manifold absolute pressure of said engine; and, a computer readable program code means for causing said computer to infer a new manifold absolute pressure based on said obtained manifold absolute pressure and said calculated difference in mass air flow.

12. An article of manufacture according to claim 11 further comprising:

a computer readable program code means for causing said computer to convert said inferred manifold absolute pressure into said fuel pump correction signal.

13. An article of manufacture according to claim 12 wherein said computer storage medium comprises an electronically programmable chip.

14. An article of manufacture according to claim 10 wherein said computer storage medium comprises an electronically programmable chip.

* * * * *